US005668586A

United States Patent [19]

Tanaka

[11] Patent Number: 5,668,586

[45] Date of Patent: Sep. 16, 1997

[54] RECORDING MEDIUM FOR USE IN THERMAL TRANSFER PRINTING OPERATIONS AND HOT-MELTING-TYPE THERMAL TRANSFER PRINT SYSTEM USING THE SAME

[75] Inventor: Hideshi Tanaka, Yokohama, Japan

[73] Assignee: Victor Company of Japan, Ltd., Yokohama, Japan

[21] Appl. No.: 401,900

[22] Filed: Mar. 10, 1995

[30] Foreign Application Priority Data

Mar. 11, 1994 [JP] Japan ..... 6-067814

[51] Int. Cl.[6] ..... B41J 2/325

[52] U.S. Cl. ..... 347/221; 347/183

[58] Field of Search ..... 347/221, 183; 400/120.07

[56] References Cited

U.S. PATENT DOCUMENTS 5,521,626 5/1996 Tanaka et al. ..... 347/221

FOREIGN PATENT DOCUMENTS 59-95194 6/1984 Japan .
60-110488 6/1985 Japan .
62-197183 8/1987 Japan .
63-77758 4/1988 Japan .

*Primary Examiner*—Huan H. Tran
*Attorney, Agent, or Firm*—Pollock, Vande Sande & Priddy

[57] ABSTRACT

A thermal transfer recording medium 2, used for a hot-melting-type thermal transfer print system using a hot-melting-type ink, comprises a substrate 2*b*, and a multi-grooved layer 2*a* formed on this substrate 2*b*. A plurality of thin grooves 2*a*1 are formed on a surface of the multi-grooved layer 2*a*. Each thin groove 2*a*1 has a width of 1–10 μm and a length longer than a pixel at least in an auxiliary scanning direction. When a hot-melting-type ink 1*a* is transferred onto the thermal transfer recording medium 2, the ink 1*a* smoothly permeates into the thin groove 2*a*1 and extends along the elongated recess thereof, thereby providing an excellent multi-gradational image with excellent resolution and quality.

12 Claims, 12 Drawing Sheets

RECORDING MEDIUM FOR USE IN THERMAL TRANSFER PRINTING OPERATIONS AND HOT-MELTING-TYPE THERMAL TRANSFER PRINT SYSTEM USING THE SAME

BACKGROUND OF THE INVENTION

1. Field of the Invention

This invention relates to a recording medium for use in thermal transfer printing operations and a hot-melting-type thermal transfer print system for realizing a multiple gradational expression using hot-melting-type ink.

2. Prior Art

To realize a multiple gradational expression using hot-melting-type ink, conventionally available methods are generally a dither method using a plurality of pixels (matrix) for obtaining a multi-gradational image or a thermal concentration method using a special thermal head with a small heat generator for also obtaining a multi-gradational image. (For example, refer to Photographic Industrial Publisher Co. Ltd, IMAGING Part 1, p103–p108)

According to the conventional hot-melting-type thermal transfer printing technologies, there is a problem that using a plurality of pixels may deteriorate the resolution and therefore quality of a resultant image is undesirably lowered. On the other hand, using a special thermal head is not preferable in view of another problem of cost increase.

SUMMARY OF THE INVENTION

Accordingly, in view of above-described problems encountered in the prior art, a principal object of the present invention is to provide a recording medium for use in thermal transfer printing operations and a hot-melting-type thermal transfer print system capable of providing an excellent multi-gradational-image with high resolution and high quality.

In order to accomplish this and other related objects, a first aspect of the present invention provides a recording medium for use in a hot-melting-type thermal transfer print system using a hot-melting-type ink, the recording medium comprising: a substrate; a multi-grooved layer formed on the substrate; a plurality of thin grooves formed on a surface of the multi-grooved layer, each thin groove having a width of 1–10 μm and a length longer than a pixel at least in an auxiliary scanning direction.

A second aspect of the present invention provides a hot-melting-type thermal transfer print system comprising: an ink ribbon including a thin film on which a hot-melting-type ink is applied with a coating amount not larger than 2.5 g/m$^2$, the hot-melting-type ink being a mixture of paint material and hot-melting-type binder; a multi-grooved recording medium including a substrate and a multi-grooved surface layer formed on the substrate, the multi-grooved surface layer having a plurality of thin grooves, each thin groove having a width of 1–10 μm; a thermal head with a plurality of heat generators, arrayed in a line so as to provide a temperature gradient with highest temperatures in a central region thereof and lower temperatures in a peripheral region thereof; and a gradation control circuit controlling a power supply to the thermal head, so as to control a melting area of the ink when the ink is heated by the heat generators; wherein the ink of the ink ribbon is laid on the multi-grooved surface layer of the multi-grooved recording medium, a pressing force is applied to the thermal head from the same side as the thin film of the ink ribbon, the gradation control circuit controls the melting area of the ink, thereby obtaining a gradational image on the multi-grooved recording medium.

BRIEF DESCRIPTION OF THE DRAWINGS

The above and other objects, features and advantages of the present invention will become more apparent from the following detailed description which is to be read in conjunction with the accompanying drawings, in which:

FIGS. 2A–2C are views illustrating the thermal transfer recording medium in accordance with the present invention, wherein FIG. 2A is a perspective view, FIG. 2B is a plan view and FIG. 2C is a cross-sectional side view;

FIGS. 5A and 5B are views showing the ink ribbon used in the hot-melting-type thermal transfer print system in accordance with the present invention, wherein FIG. 5A is a perspective view and FIG. 5B is a cross-sectional view;

DETAILED DESCRIPTION OF THE PREFERRED EMBODIMENTS

Preferred embodiments of the present invention will be explained in greater detail hereinafter, with reference to the accompanying drawings. Identical parts are denoted by identical reference number 5 throughout views.

Figure 3:
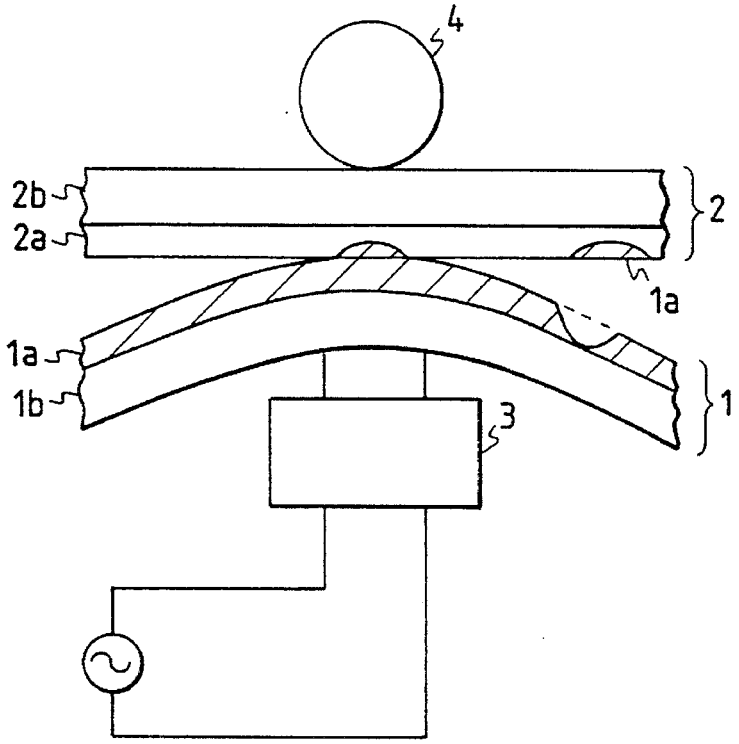
FIG. 3 is an enlarged view showing an essential part of a hot-melting-type thermal transfer print system in accordance with the present invention.

First, a preferred example of a hot-melting-type thermal transfer print system embodying the present invention will be explained. The hot-melting-type thermal transfer print system of the present invention, as shown in FIG. 3, comprises a thermal head 3 and a platen roller 4, between which an ink ribbon 1 and a multi-grooved recording medium 2 are overlapped and transported in a predetermined feed direction. The multi-grooved recording medium 2 serves as a recording medium used for thermal transfer printing purposes of the present invention later described. The thermal head 3, pressed against the platen roller 4, includes heat generators which supply heat to the ink ribbon 1 when they are actuated, thereby melting and transferring ink 1*a* of the ink ribbon 1 onto the multi-grooved recording medium 2.

Figure 4:
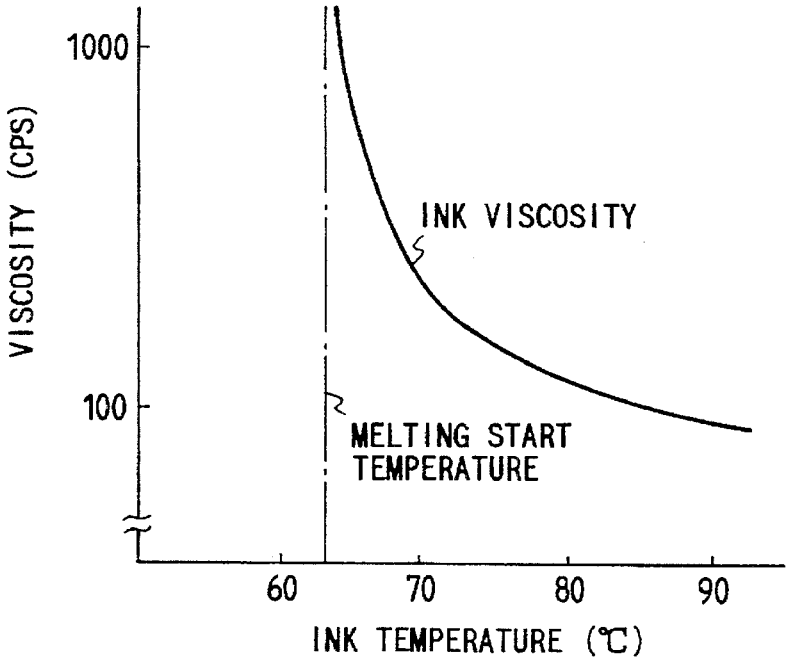
FIG. 4 is a graph showing a relationship between ink temperature and obtainable viscosity in an ink ribbon used in the hot-melting-type thermal transfer print system in accordance with the present invention.

As is well known, the heat generators of the thermal head 3 are generally formed in a rectangular shape, which bring a temperature gradient with highest temperatures in the central region of the heat generators and lower temperatures in the peripheral region of the heat generators. Thus, the ink 1*a* melts in the region where the temperature exceeds the melting point of the ink 1*a*. Utilizing such a temperature gradient, the melting area of the ink 1*a* can be controlled. FIG. 4 shows a relationship between ink temperature and obtainable viscosity in the ink 1*a* of the ink ribbon 1. In a temperature region higher than the melting point, the viscosity decreases with increasing temperature. In other words, when the ink ribbon 1 is brought into contact with the heat generators and receives heat from the same, the ink viscosity is lowest in the central region of the heat generators and highest in the peripheral region of the heat generators due to the temperature gradient described above. Accordingly, an ink amount permeable into the multi-grooved recording medium 2 is largest in the central region of the heat generators and smallest in the peripheral region of the heat generators. Thus, by varying a value of current flowing through the heat generators in accordance with a given gradational expression, it becomes possible to simultaneously control the permeable amount and permeable area of the ink 1*a*. Thus, the multiple gradational expression can be easily realized.

In general, the surface temperature of the recording medium varies in accordance with the thickness of the ink ribbon. More specifically, the temperature gradient of the ink ribbon approximates to that of the heat generators with reducing thickness of the ink ribbon. Thus, a thin ink ribbon is preferable because it brings a temperature gradient sufficiently steep to facilitate the control of the ink melting area. In practical use, a limit of the film thickness of the ink ribbon is approximately 3.5 μm. That is why a thin film of 3.5 μm thick is used for the ink ribbon. The thickness of the ink ribbon is generally determined by a thickness of a film and a thickness of an ink applied on the film. Accordingly, the temperature gradient of a surface of the recording medium approximates to that of the heat generators with decreasing ink amount applied on the film.

Figure 5A:
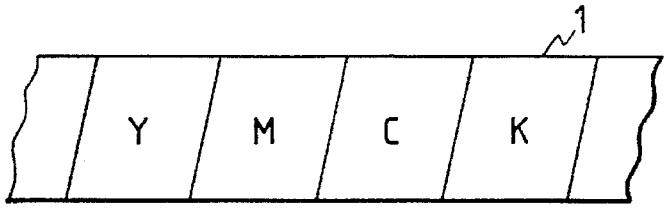
Figure 5B:
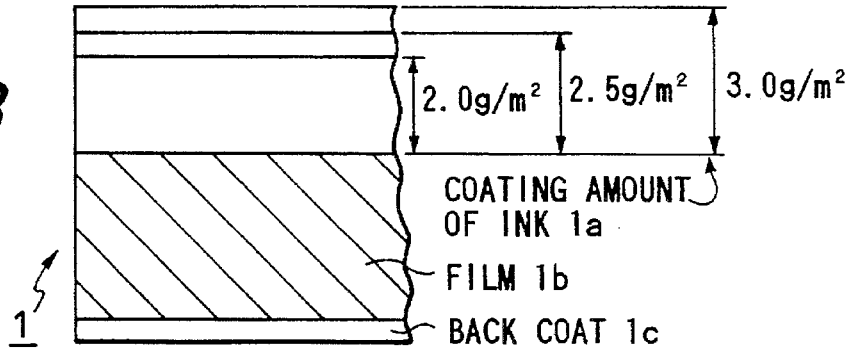

FIGS. 5A and 5B show the ink ribbon 1 used in the hot-melting-type thermal transfer print system in accordance with the present invention, FIG. 5A being a perspective view and FIG. 5B being a cross-sectional view. This ink ribbon 1, as shown in FIG. 5A, includes consecutive inks 1*a*, each ink 1*a* being a set of a plurality of colors, such as yellow (Y), magenta (M), cyan (C) and black (K), arrayed in a longitudinal direction of the ink ribbon 1. The ink 1*a* is a mixture of paint material and hot-melting-type binder. As shown in FIG. 5B, the hot-melting-type ink 1*a* is applied on a thin film 1*b* of 3.5 μm thick having a back coat 1*c* of 0.05 μm thick.

Figure 6:
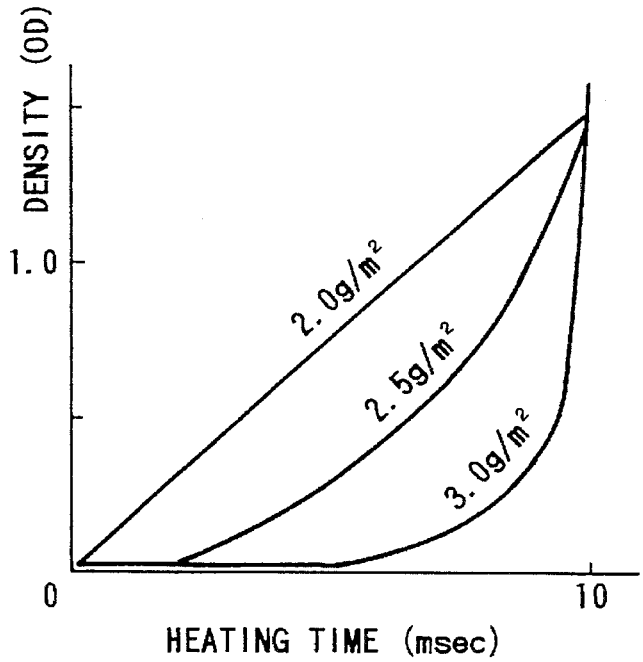
FIG. 6 is a graph showing variations in the relationship between heating time of the ink ribbon and resultant ink density found when an ink coating amount is varied in the range of 2.0 g/m$^2$ to 3.0 g/m$^2$.

FIG. 8 is a graph showing the relationship between heating time of the ink ribbon and resultant ink density (OD) on the recording medium when the ink coating amount is set to each of 2.0 g/m$^2$, 2.5 g/m$^2$ and 3.0 g/m$^2$. In a conventional ink ribbon, an ink more than 3.0 g/m$^2$ is generally applied on a 3.5 μm film. However, in view of the result of FIG. 6, it is understood that the multiple gradational expression is preferably realized by setting the ink coating amount to be not larger than 2.5 g/m$^2$. Although the film thickness is 3.5 μm in this embodiment, a similar effect will be attained unless the film thickness exceeds 4.5 μm.

Figure 1:
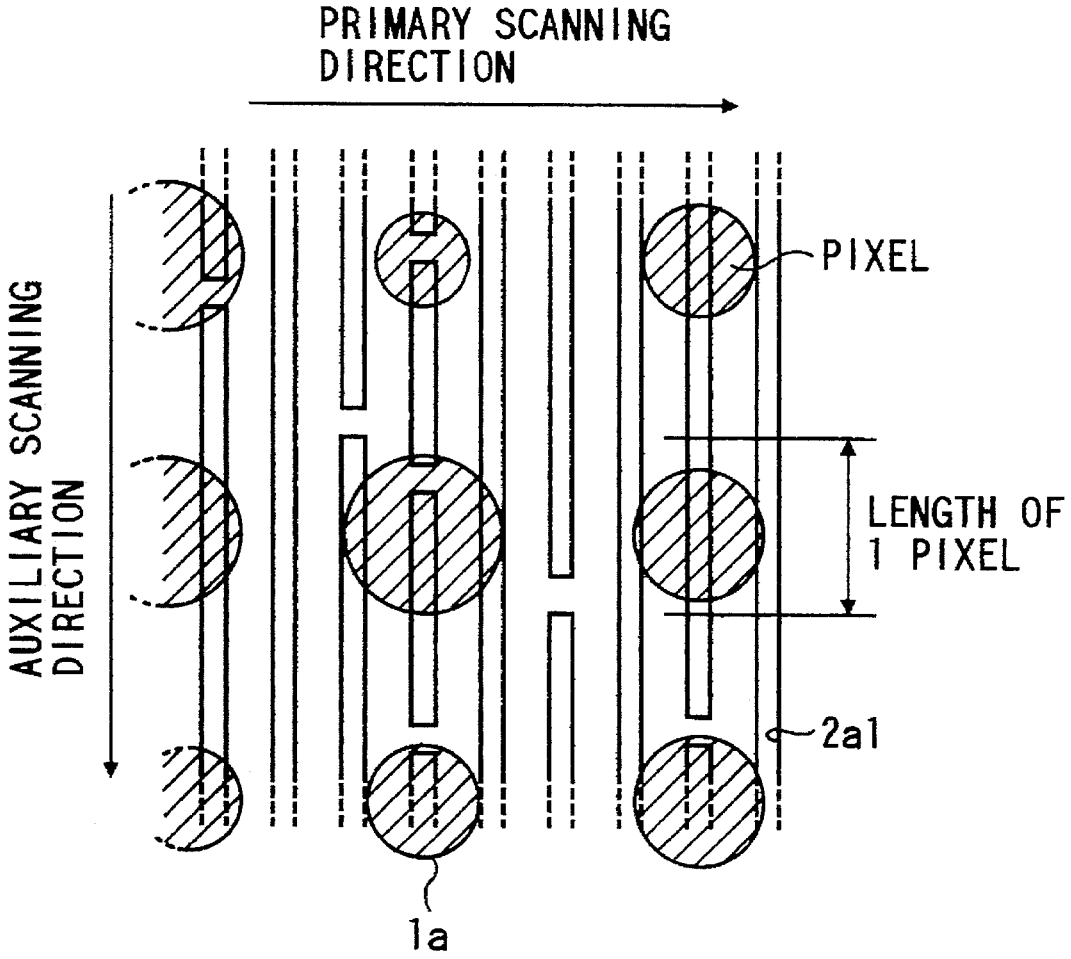
FIG. 1 is a view showing one example of a recording medium for use in thermal transfer printing operations in accordance with the present invention.
Figure 2A:
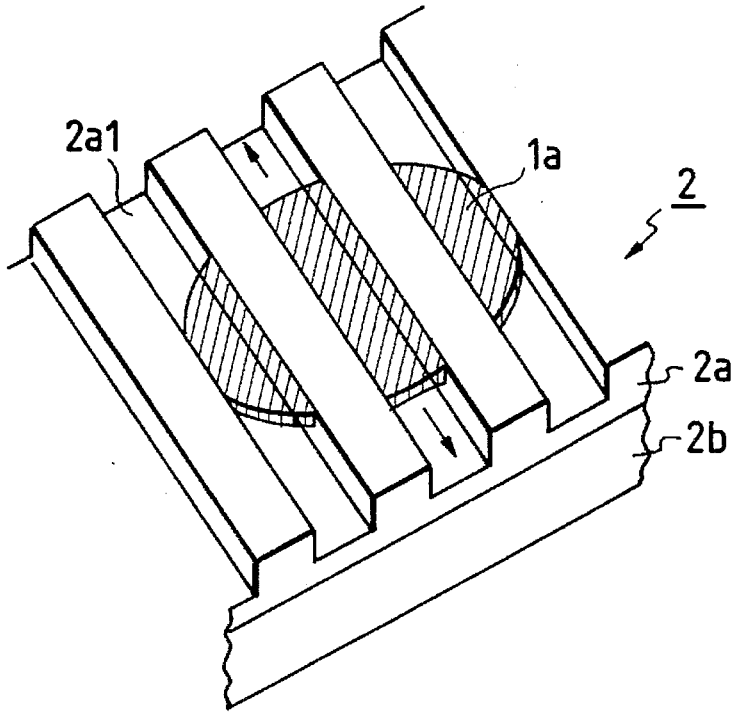
Figure 2B:
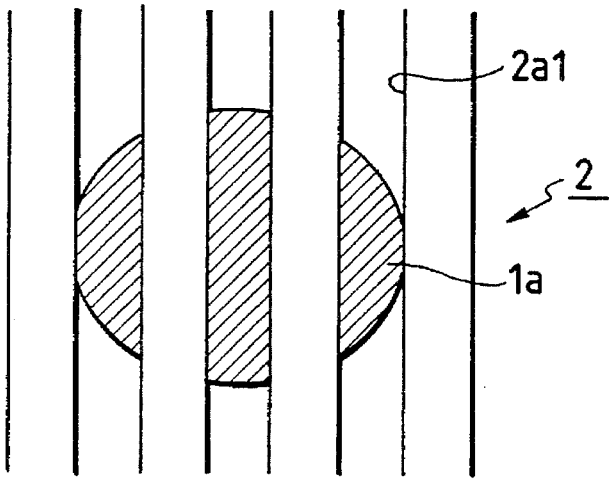
Figure 2C:
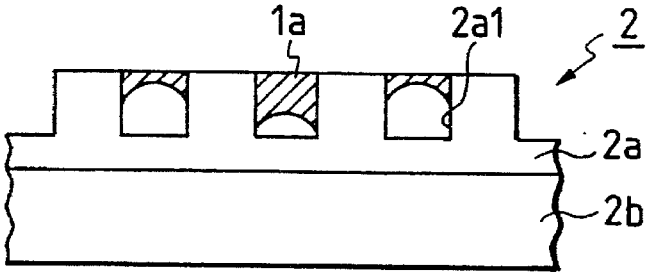

Next, the multi-grooved recording medium 2 used in the present invention will be explained in greater detail. As shown in FIGS. 2A, 2B and 2C, the multi-grooved recording medium 2 comprises a multi-grooved surface layer 2*a* of approximately 10 μm or over formed on a substrate 2*b* chiefly containing plastic, such as synthetic sheet or polyester. The multi-grooved surface layer 2*a* includes numerous thin grooves 2*a*1, formed on the upper surface thereof in parallel with each other as clearly shown in the drawings. It is preferable that the direction of each thin groove 2*a*1 is substantially identical with an auxiliary scanning direction of the thermal head 3 as shown in FIG. 1. Furthermore, it is preferable that the length of each thin groove 2*a*1 is not shorter than the length of a pixel. Using the multi-grooved recording medium 2 with such multi-grooved surface layer 2*a* formed thereon enables the hot-melting-type ink 1*a* to enter in the elongated recess of thin groove 2*a*1 in the transferring operation as shown in FIG. 2A. Since air is easily pushed away in response to invasion or permeation of the ink 1*a*, the ink 1*a* can smoothly extend along the thin groove 2*a*1. Thus, the ink density can be controlled in a fairly wide range.

A manufacturing method of the multi-grooved recording medium 2 will be explained below. First, a photosensitive layer is formed on the substrate 2*b*. Then, the photosensitive layer is irradiated with light of a predetermined multi-groove pattern. Thereafter, the photosensitive layer corresponding to each groove portion is removed off by an appropriate development processing. Alternatively, white paint can be partly printed on the substrate 2*b* so as to form multiple grooves. On the contrary, it is also possible to uniformly apply the white paint on the entire surface of the substrate 2*b* and then cut off the white paint partly so as to leave the multiple grooves.

The inventor of this invention found that, to optimize the multiple gradational expression, the thin groove 2*a*1 of the multi-grooved surface layer 2 needs to satisfy the predetermined conditions on its size.

Figure 7:
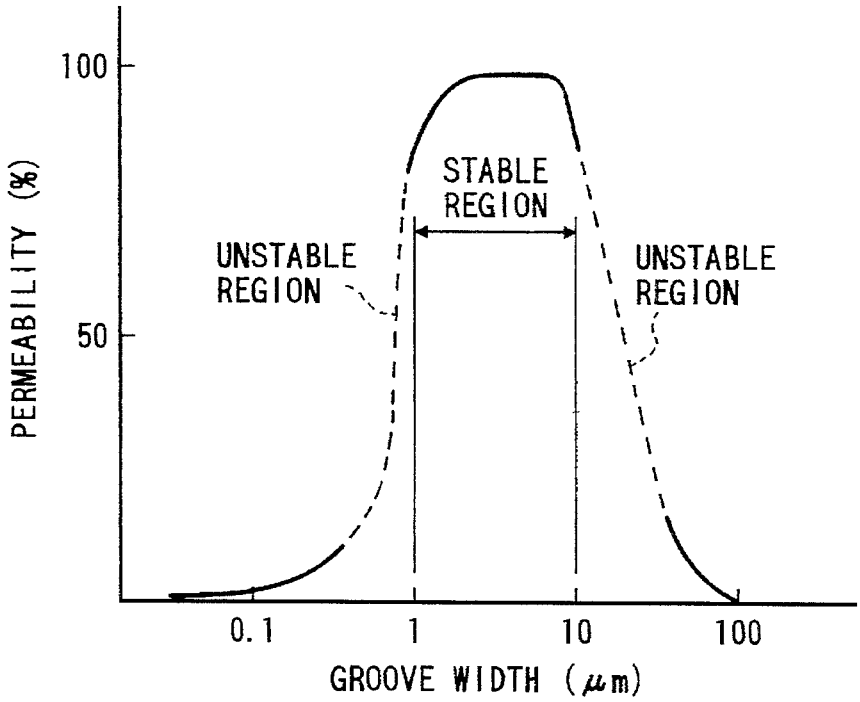
FIG. 7 is a graph showing a relationship between groove Width and attainable ink permeability in a multi-grooved surface layer of the thermal transfer recording medium in accordance with the present invention.

FIG. 7 is a graph showing a relationship between the groove width of multi-grooved surface layer 2*a* and an attainable ink permeability of the ink 1*a*. This graph shows a clear criticality in that an excellent permeability is acquired only when the groove width of the multi-grooved surface layer 2*a* is in the range of approximately 1–10 μm.

Figure 8A:
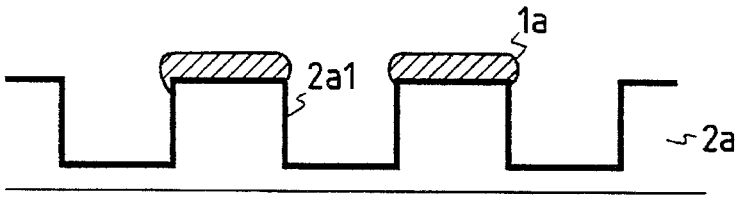
FIGS. 8A, 8B and 8C are cross-sectional views illustrating the difference of permeability found when ink is transferred on the multi-grooved surface layer, among three examples whose groove widths are different from each other.
Figure 8B:
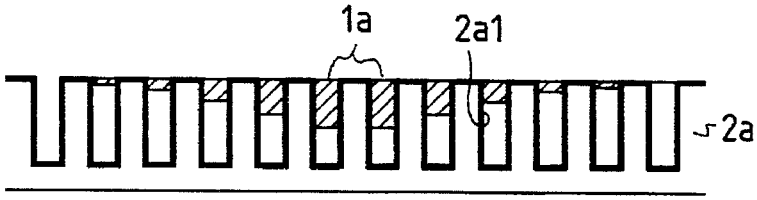
Figure 8C:
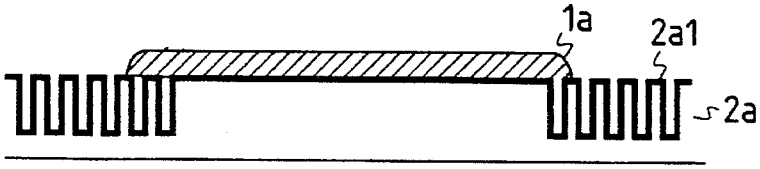

FIGS. 8A, 8B and 8C are cross-sectional views illustrating the difference of permeability found when the ink 1*a* is transferred on the multi-grooved surface layer 2*a*, among three examples whose groove widths are more than 10 μm (FIG. 8A), 1–10 μm (FIG. 8B), and less than 1 μm (FIG. 8C), respectively. When the groove width is larger than 10 μm, as shown in FIG. 8A, almost all of ink 1*a* is transferred onto the upper surface of the multi-grooved surface layer 2*a* without permeating into the groove. It results in a lack of ink 1*a* in the region of grooves and the ink 1*a* is unstable. If a plurality of color inks 1*a* are successively transferred, there is a large possibility that the transfer operation ends defective since a newly transferred ink 1*a* will be adversely affected by the thickness of an unstable precedent ink 1*a*.

Similarly, when the groove width is less than 1 μm, as shown in FIG. 8C, almost all of the ink 1*a* is transferred onto the upper surface of the multi-grooved surface layer 2*a* without permeating into the groove. Therefore, settlement of ink 1*a* is unstable and the transfer of plural colors may be faulty. Hence, it is difficult to accurately achieve a desirable multiple gradational expression.

Meanwhile, when the groove width is in the range of 1–10 μm, as shown in FIG. 8B, the ink 1*a* permeates in the thin groove 2*a*1 of the multi-grooved surface layer 2*a*. An amount of ink 1*a* permeable into the thin groove 2*a*1 is proportional to the temperature of the ink 1*a*. Namely, an amount of molten ink 1*a* transferred into the thin groove 2*a*1 varies in accordance with the temperature gradient of the multi-grooved surface layer 2*a*. More specifically, the region corresponding to the central region of the heat generators is a region having relatively higher temperatures; therefore, a large amount of molten ink 1*a* is transferred into the thin groove 2*a*1 in this central region. On the contrary, the region corresponding to the peripheral region of the heat generators is a region having relatively low temperatures; therefore, a small amount of molten ink 1*a* is transferred into the thin groove 2*a*1 in this peripheral region. Furthermore, in cases where a plurality of color inks 1*a* are successively transferred, there is no possibility that a newly transferred ink 1*a* will be adversely affected by the thickness of a precedent ink 1*a*. Thus, for the groove thickness of 1–10 μm shown in FIG. 8B, the transfer operation is successful and stable. In short, the transfer amount of ink 1*a* can be controlled by the heating temperature. Thus, an intended multiple gradational expression can be easily realized.

Figure 9A:
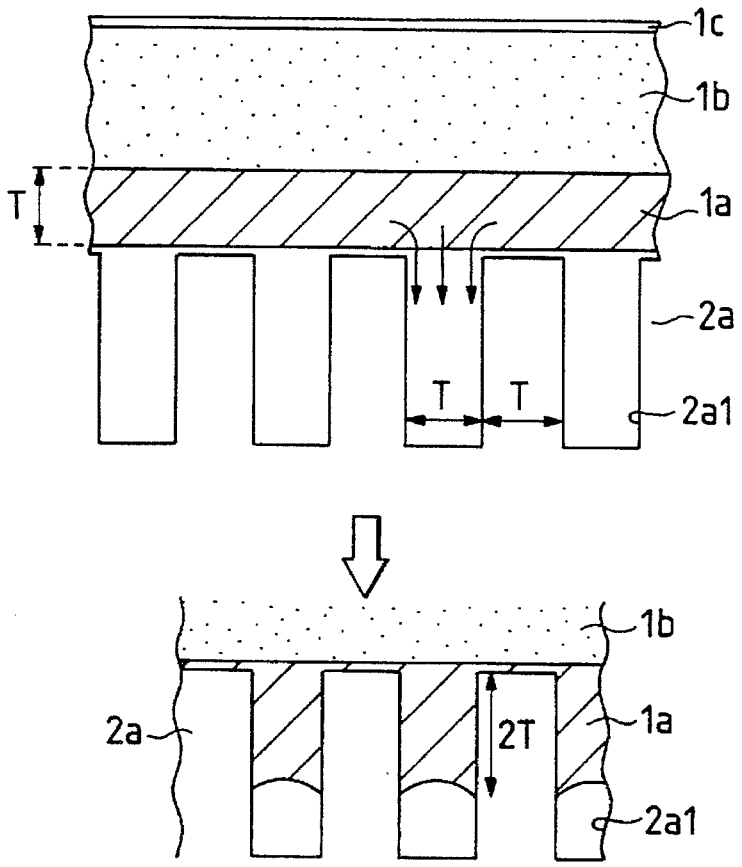
FIGS. 9A and 9B are cross-sectional views showing examples of a multi-grooved recording medium, respectively illustrating a relationship between a groove width k of the multi-grooved surface layer, a particle size $\phi$ of paint material of the ink ribbon, and a thickness T of the applied ink.
Figure 9B:
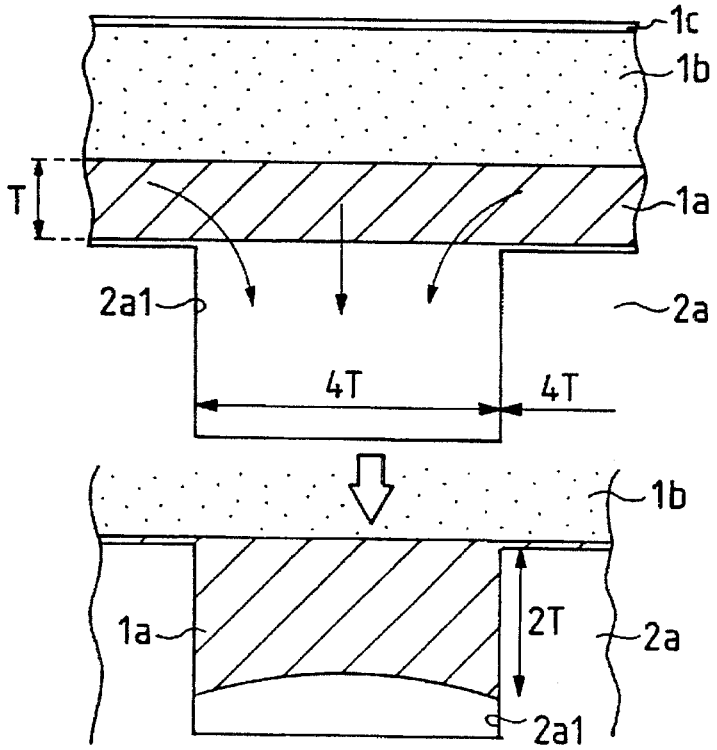

The groove width of the multi-grooved surface layer 2*a* of the multi-grooved recording medium 2 can be also optimized from another view point. It is assumed that k represents the groove width of the thin groove 2*a*1, ϕ represents a particle size of paint of the ink 1*a* in the ink ribbon 1, and T represents a coating thickness of the ink 1*a* in the ink ribbon 1. FIGS. 9A and 9B are cross-sectional views showing two examples of the multi-grooved recording medium, which derives an optimum relationship between the groove width k of the multi-grooved surface layer 2*a*, the particle size Φ of paint of the ink ribbon 1, and the thickness T of the applied ink 1*a*.

In the example shown in FIG. 9A, the groove width k of the thin groove 2*a*1 is identical with the thickness T of the applied ink 1*a*. Numerous thin grooves 2*a*1 are arrayed at regular intervals in parallel with each other, the interval of adjacent two of them is also identical with the thickness T of the applied ink 1*a*. When the molten ink 1*a* fully permeates into the thin groove 2*a*1 by capillary phenomenon, an ink pillar of 2T deep is formed in each thin groove 2*a*1. If the ink coating amount is 2.0 g/m$^2$ (=approximately 2.0 μm), an actual size of the ink pillar 1*a* will be approximately 4 μm.

In this case, the-top surface of the ink pillar 1*a* in each thin groove 2*a*1 is brought into contact with the thin film 1*b* in the region equivalent to the groove width k=T. Meanwhile, at the side surfaces, the ink pillar 1*a* is brought into contact with the inside walls of the thin groove 2*a*1. Accordingly, for the ink pillar 1*a* of FIG. 9A, a ratio of the adhesion to the thin film 1*b* to the adhesion to the inside wall of the thin groove 2*a*1 is approximately 1:4. Thus, the ink 1*a* is easily peeled off the thin film 1*b* of the ink ribbon 1 and smoothly transferred into the thin grooves 2*a*1 of the multi-grooved surface layer 2*a*.

On the other hand, in the example shown in FIG. 9B, the groove width k of the thin groove 2*a*1 is as large as four times the thickness T of the applied ink 1*a*. Numerous thin grooves 2*a*1 are arrayed at regular intervals in parallel with each other, the interval of adjacent two of them is also identical with four times the thickness T of the applied ink 1*a*. When the molten ink 1*a* fully permeates into the thin groove 2*a*1 by capillary phenomenon, an ink pillar of 2T deep is formed in each thin groove 2*a*1. If the ink coating amount is 2.0 g/m$^2$ (=approximately 2.0 μm), an actual size of the ink pillar 1*a* will be approximately 4 μm.

In this case, the top surface of the ink pillar 1*a* in each thin groove 2*a*1 is brought into contact with the thin film 1*b* in the region equivalent to the groove width k=4T. Meanwhile, at the side surfaces, the ink pillar 1*a* is brought into contact with the inside walls of the thin groove 2*a*1. Accordingly, for the ink pillar 1*a* of FIG. 9B, the ratio of the adhesion to the thin film 1*b* to the adhesion to the inside wall of the thin groove 1*a*1 is approximately 1:1. In general, the adhesion of ink 1*a* to the thin groove 2*a*1 is stronger than that to the thin film 1*b* at the moment after the heating operation is finished, simply because the multi-grooved recording medium 2 is far from the thermal head 3 and is, therefore, cooled down faster than the ink ribbon 1. Thus, even in a condition that the adhesion to the thin film 1*b* is identical with the adhesion to the inside wall of the thin groove 2*a*1, the ink 1*a* can be surely peeled off the thin film 1*b* and transferred into the thin groove 2*a*1 of the multi-grooved surface layer 2*a* if the ink ribbon 1 is quickly separating from the multi-grooved recording medium 2 as soon as the thermal head 3 terminates the heating operation.

The shortest value of the groove width k is the particle size ϕ of paint material of the ink 1*a*, since any molten ink 1*a* of particle size ϕ cannot permeate into the thin groove 2*a*1 if its groove width is smaller than ϕ.

In view of the above considerations, the groove width k of the thin groove 2*a*1 of multi-grooved surface layer 2*a* can be optimized with the following equation 1 using the paint particle size ϕ of ink ribbon 1 and the applied ink thickness T as follows.

$$\phi \leqq k \leqq 4T \tag{1}$$

As long as the groove width k of the thin groove 2*a*1 of multi-grooved surface layer 2*a* satisfies the above equation 1, it becomes possible to realize an effective ink permeation in proportion to the total heating amount.

Using such a multi-grooved recording medium 2, the inventor of the present invention found that an excellent multiple gradational expression is easily realized. More specifically, the ink 1*a* of the ink ribbon 1 is laid on the multi-grooved surface layer 2*a* of the multi-grooved recording medium 2. Then, the thermal head 3 is pressed from the same side as the film 1*b* of the ink ribbon 1 against the platen roller 4. Electric power amount to be supplied to the thermal head 3 is controlled with reference to the temperature gradient of the heat generator, thereby controlling the molten area of the ink 1*a*. When melted, the ink 1*a* can be easily and promptly transferred from the ink ribbon 1 to the multi-grooved surface layer 2*a* of the multi-grooved recording medium 2 and absorbed there in accordance with the heating amount generated from the thermal head 3. Thus, the multi-gradational image with high resolution and high quality is surely obtained.

Figure 10:
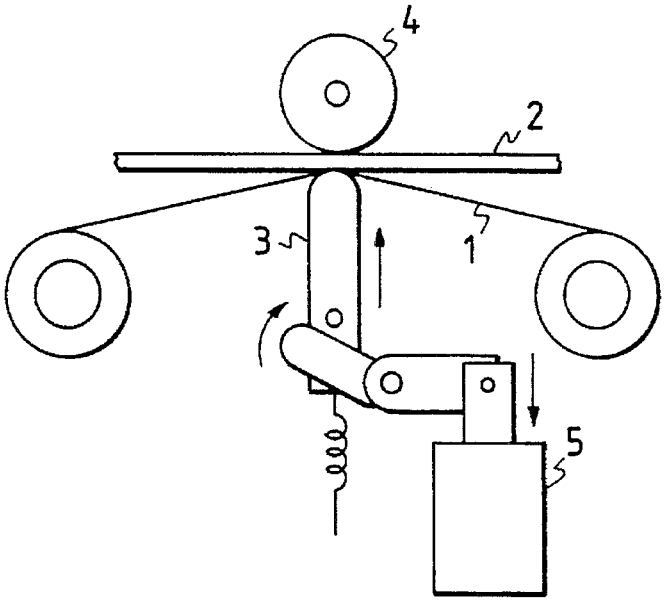
FIG. 10 is a view schematically showing an arrangement of one example of an essential part of an improved hot-melting-type thermal transfer print system in accordance with the present invention, which includes a pressing device.

If a pressing force of the thermal head 3 against the platen roller 4 is insufficient, there is a possibility that the ink 1*a* remains on the upper surface of the multi-grooved recording medium 2. That is, it is feared that the ink 1*a* is not satisfactorily transferred and absorbed in the thin groove 2*a*1 of the multi-grooved recording medium 2. FIG. 10 shows a schematic arrangement of one example of an essential part of an improved hot-melting-type thermal transfer print system in accordance with the present invention. In FIG. 10, a reference numeral 1 represents an ink ribbon; a reference numeral 2 represents a multi-grooved recording medium; a reference numeral 3 represents a thermal head; a reference numeral 4 represents a platen roller; and a reference numeral 5 represents a plunger acting as the pressing device. The plunger 5 has a shaft movable in an axial direction thereof. More specifically, when voltage is applied to the plunger 5, the plunger shaft is pulled down in the direction of an arrow. The thermal head 3 is pressed against the platen roller 4 through the ink ribbon 1 and the multi-grooved recording medium 2. When the plunger 5 is operated in such a manner that controls the pressing force of the thermal head 3 in the transfer operation of the ink 1*a* onto the multi-grooved recording medium 2, it is ensured that the ink 1*a* certainly permeates into the thin groove 2*a*1 of the multi-grooved recording medium 2, thereby definitely obtaining the multi-gradational image with high resolution and high quality.

Figure 11:
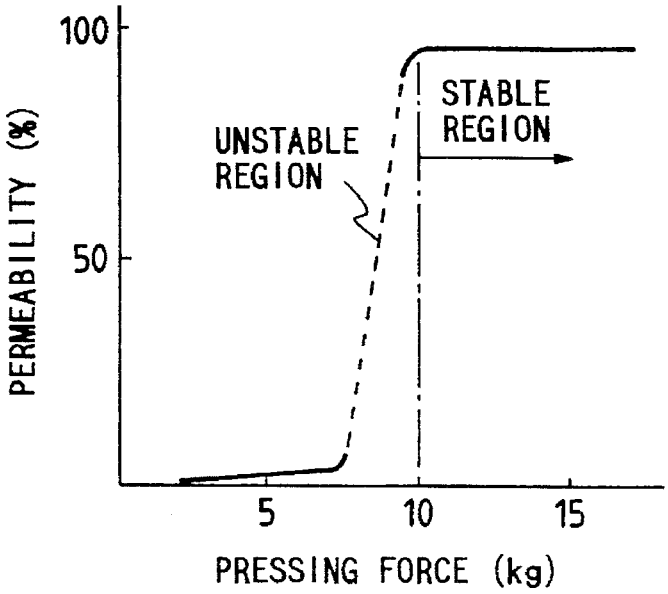
FIG. 11 is a graph showing a relationship between pressing force of the pressing device and obtainable permeability to the multi-grooved recording medium.

FIG. 11 is a graph showing a relationship between a pressing force (kg) of the pressing device and a permeability (%) to the multi-grooved recording medium 2, obtained as a result of an experiment conducted under the conditions that the film thickness of ink ribbon 1 is 3.5 μm, the ink coating amount is 2.0 g/m$^2$, the groove width of thin groove 2*a*1 is 1–10 μm, the printing length of the thermal head 3 is 260 mm (26 cm), and the heat generating interval of the thermal head 3 is 84.5 μm (12 dots/mm). The configuration of the heat generator was a partial glaze. For example, a heat generating interval of a thermal head used in a facsimile equipment is approximately 8 dots/mm. Thus, to obtain a multi-gradational image sufficiently visible with high resolution and high quality, a required interval of the heat generators will be not larger than 8 dots/mm.

According to a conventional apparatus, the thermal head 3 having the above printing length provides a pressing force of 4–6 kg. However, according to the experiment of the inventor (FIG. 11), a pressing force less than 8 kg could not stabilize the transferring operation of the ink 1*a*, the ink 1*a* merely settling on the upper surface. When the pressing force is increased up to 9 kg, it was found that a small amount of ink 1*a* permeated into the thin groove 2*a*1. And, when the pressing force exceeded 10 kg, it was always recognized that the ink 1*a* nicely permeated into the thin groove 2*a*1. From the above result (i.e. 9 kg/26 cm=0.346 - - - ), it is believed that a preferable result is surely obtained every time the pressing force per unit length of the printing length of the thermal head 3 is not less than 0.35 kg/cm.

Figure 12:
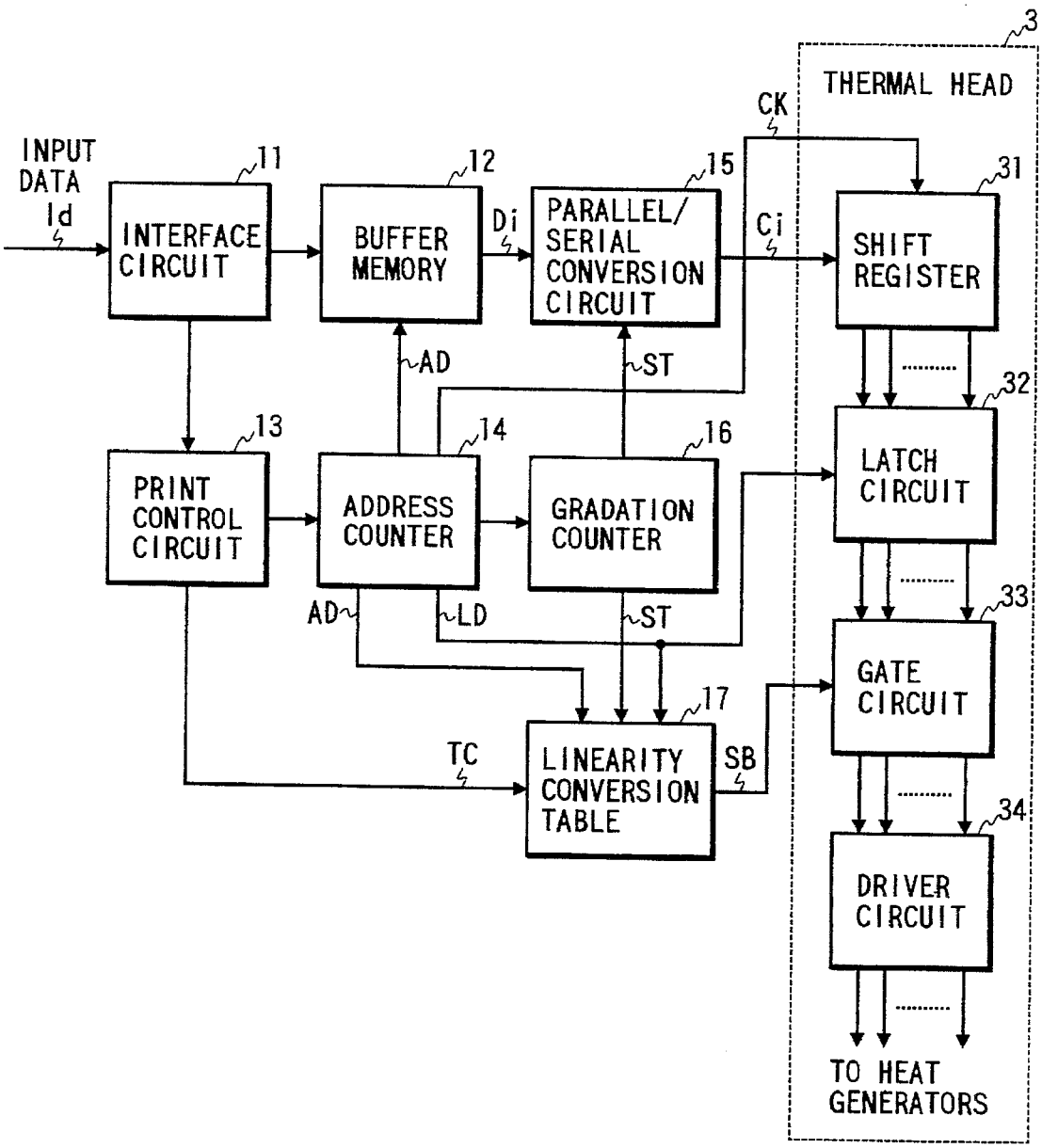
FIG. 12 is a block diagram showing an arrangement of one example of a gradation control circuit used in the hot-melting-type thermal transfer print system in accordance with the present invention.

Next explained is one example of a gradation control circuit for controlling a melting area of the ink 1*a* by changing the power supply to the thermal head 3, which is incorporated in a hot-melting-type thermal transfer print system of the present invention. In FIG. 12, an interface circuit 11 receives an input data Id produced by processing an image data by a personal computer, the image data being obtained from an image input device such as a television camera. This input data Id includes control data in addition to image data, the control data being necessary for a printing device. The input data Id indicates a gradation number corresponding to the image to be printed. Of input data Id entered into the interface circuit 11, the image data are supplied to a buffer memory 12 while the control data are supplied to a print control circuit 13. The print control circuit 13 generates various control signals in accordance with the operation of the printing device. The printing device comprises the thermal head 3 and the ink ribbon which cooperatively act as a printing means.

Figure 13:
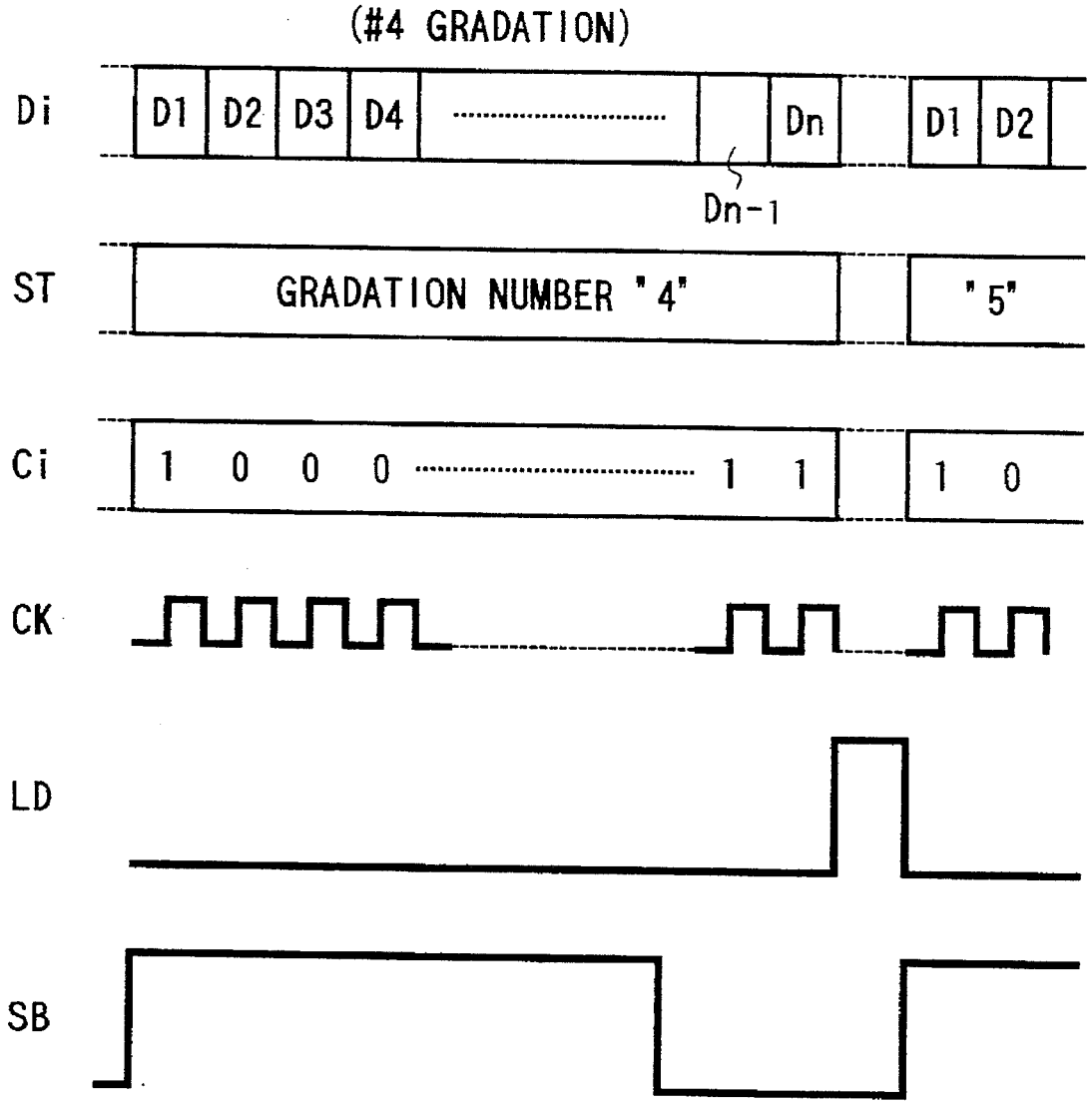
FIGS. 13 and 14 are views illustrating the operation of the gradation control circuit shown in FIG. 12.
Figure 14:
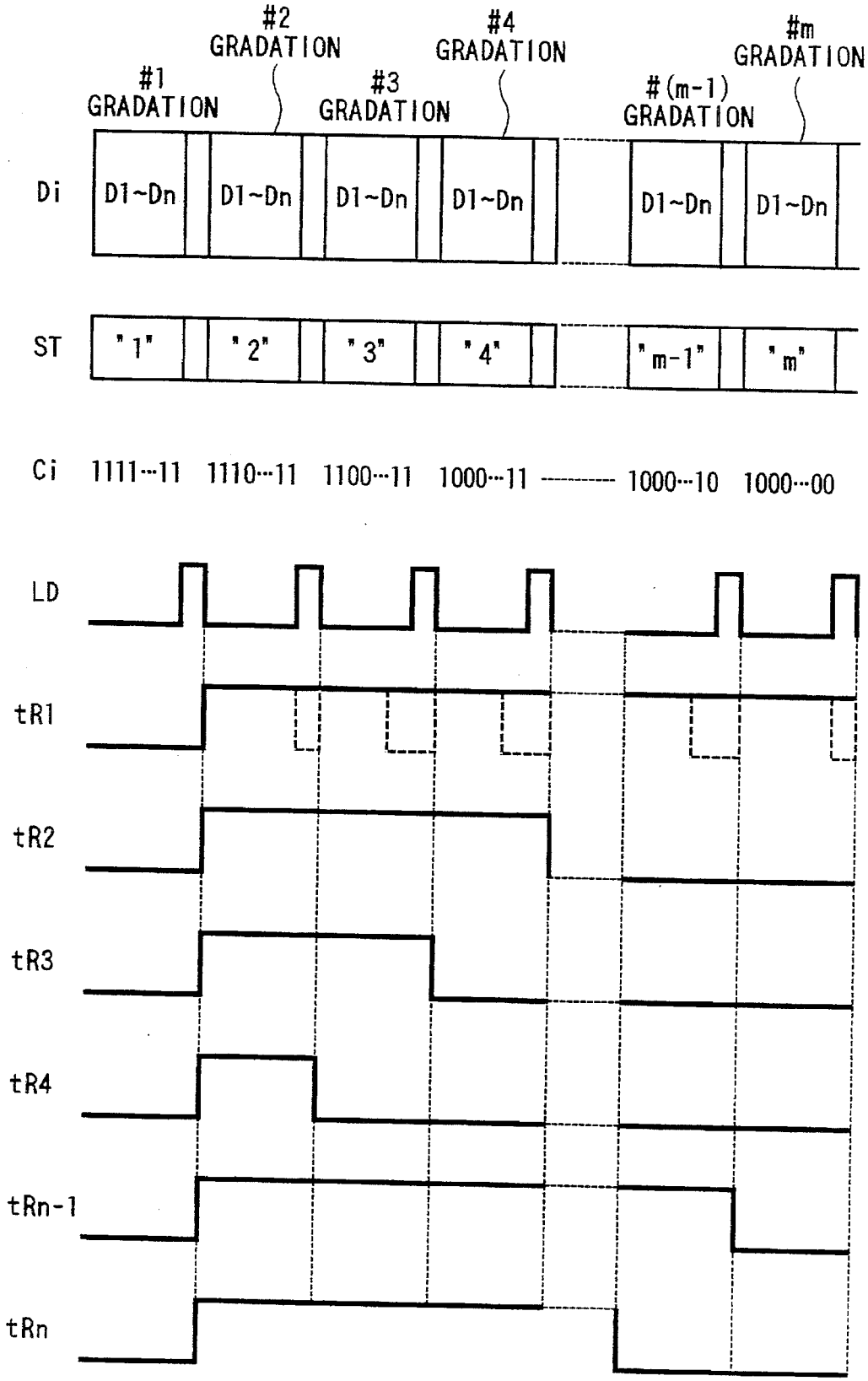

The print control circuit 13 supplies a start signal to an address counter 14 in synchronism with the operation of the printing device, and also supplies a selection signal TC to a linearity conversion table 17. The selection signal TC is generated based on the operational conditions of the printing device - e.g. required ink colors of the ink ribbon, and heating patterns for printing. The address counter 14 generates an address AD in response to the start signal, and supplies it to the buffer memory 12. The buffer memory 12, in response to the address AD, successively generates data Di (D1–Dn) based on the image data and sends the same to a parallel/serial conversion circuit 15. The data Di (D1–Dn) corresponds to one line of the thermal head 3, as shown in FIGS. 13 and 14. FIG. 13 is a partly enlarged view of FIG. 14.

The one line data Di for the thermal head 3, generated from the buffer memory 12, will be explained in more detail. It is now supposed that the thermal head 3 with in-line heat generators (R1–Rn) is used for realizing the gradation number m. To realize the gradation number m, a total of m heating quantities (i.e. m grades of heating pulses) are provided to each of the heat generators R1–Rn.

Accordingly, the one line data Di, generated from the buffer memory 12, are constructed as a series of data D1–Dn corresponding to the heat generators R1–Rn for each gradation, and successively generated in order of gradation number from 1 through m, as shown in FIG. 14. These data Di are successively produced for each of lines (L1, L2 - - - ). A typical number known as an expressional gradation number is 256. This embodiment is also based on such a general gradation consisting of 256 grades from 0 through 255.

The address counter 14, every time the buffer memory 12 reads out the entire data Di for one line of the thermal head 3, sends out a pulse to a gradation counter 16. The gradation counter 16 generates a gradation signal ST on the basis of the pulse entered from the address counter 14, as shown in FIGS. 13 and 14. The gradation signal ST is sent to the parallel/serial conversion circuit 15 and also to the linearity conversion table 17. This gradation signal ST, as understood from FIG. 13, indicates a number representing the gradation number; "1" for the 1st gradation, "2" for the 2nd gradation, and "m" for the m gradation.

The parallel/serial conversion circuit 15 compares each data of the data Di (i.e. D1–Dn) with the gradation signal ST, and generates a comparison signal Ci as shown in FIGS. 13 and 14. More specifically, when the data Di, i.e. D1–Dn, is not larger than the gradation signal ST ($Di \geqq ST$), Ci is 1. When the data Di is smaller than the gradation signal ($Di < ST$), Ci is 0. The comparison signal Ci is stored in a shift register 31 in the thermal head 3. The shift register 31 receives a clock CK shown in FIG. 13, which is sent from the address counter 14. The comparison signal Ci entered in the shift register 31 is shifted in response to the clock CK.

Thus, the shift register 31 stores consecutive or serially arrayed comparison signals Ci corresponding to one line.

FIGS. 13 and 14 show an example based on D1=m, D2=3, D3=2, D4=1, - - - , Dn−1=m−2, and Dn=m−3. In the fourth gradation, each of gradation number of D1–Dn is compared with "4", with the result that the comparison signals Ci are successively produced as "1000 - - - 11", as shown in FIG. 13.

The address counter 14, every time the buffer memory 12 reads out the entire data Di for one line of the thermal head 3, generates a load pulse LD and sends it to a latch circuit 32 and to the linearity conversion table 17. The one line comparison signals Ci arrayed in the shift register 31 are memorized in the latch circuit 32 in response to the load pulse LD. After outputted from the latch circuit 32, the comparison signals are entered into a gate circuit 33.

The gate circuit 33 generates the control signals for activating or deactivating the heat generators R1–Rn in response to these comparison signals Ci. More specifically, when the comparison signal Ci is 1, the control signal is "ON". That is, the heat generator is turned on. When the comparison signal Ci is 0, the control signal is "OFF", the heat generator being turned off. Heat conditions of respective heat generators R1–Rn are controlled in accordance with the comparison signals Ci being set for each of the 1st to m gradations, as shown in FIG. 14. FIG. 14 specifies the heating periods tR1, tR2, tR3, tR4, tRn−1, and tRn for the heat generators R1, R2, R3, R4, Rn−1, and Rn, respectively. Heating operation of the heat generators R1–Rn is started at the same time as the generation of the next gradation data Di. Thus, the heating operation of the first gradation starts in response to the starting of transmission of the second gradation data. For example, the heat generator R1 is controlled by the comparison signals Ci "1111 - - - 11". Thus, the heat generator R1 is activated (ON) in all of the 1st to 4th gradations, - - - , (m−1) gradation, and m gradation. The heat generator R2 is controlled by the comparison signals Ci "1110 - - - 00". Thus, the heat generator R1 is activated (ON) in the 1st to 3rd gradations, but deactivated (OFF) in the remaining fourth through m gradations.

Meanwhile, the linearity conversion table 17, receiving the selection signal TC, address AD, gradation signal ST and the load pulse LD, generates a heat time setting signal SB shown in FIG. 13. This heat time setting signal SB has an ON period differentiated in accordance with each of the gradations.

Hence, the heating periods tR1 though tRn of the previously described heat generators R1–Rn are gated in response to on and off of the heat time setting signal SB in each gradation. Thus, the heat generators R1–Rn are actually actuated during the time the heat time setting signal SB is ON and the comparison signal Ci is 1. For example, the heating time of the heat generator R1 is set by a dotted line shown in FIG. 14. In this manner, the heating time of respective heat generators R1–Rn is finely set by the heat time setting signal SB in each of the 1st through m gradations.

The gate circuit 33 generates ON pulses to be supplied to respective heat generators, the ON pulses being respectively determined based upon the comparison signals Ci entered from the latch circuit 32 and the heat time setting signal SB entered from the linearity conversion table 17 as described above. ON pulses, generated from the gate circuit 33, are sent to a driver circuit 34. In short, the shift register 31, latch circuit 32, and the gate circuit 33 cooperate as pulse generating means for outputting pulses to heat respective heat generators of the thermal head 3. The driver circuit 34 supplies current to each of the heat generators R1–Rn in response to the corresponding pulse. Thus, the ink ribbon 1 is heated in response to the current supply amount, and the ink 1*a* is transferred to the recording medium, thereby printing images.

With this arrangement, a heating amount added to ink ribbon 1 can be finely controlled so as to realize an excellent multiple gradational expression.

Figure 15:
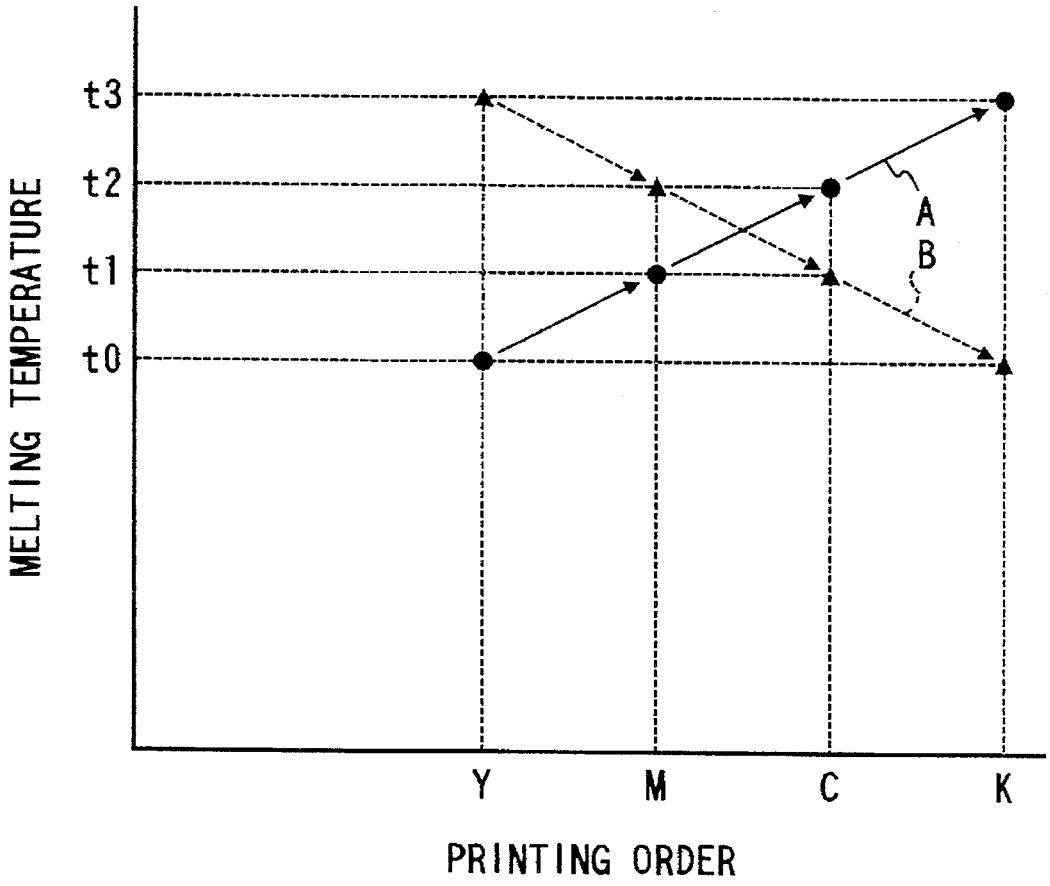
FIG. 15 is a graph illustrating the printing order of the ink ribbon.
Figure 16A:
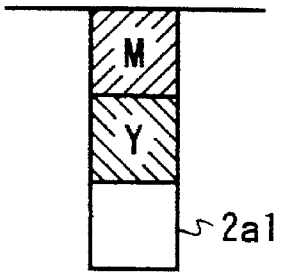
FIGS. 16A and 16B are views showing both a good transfer condition and a bad transfer condition of a multi-colored ink.

When a plurality of inks la are printed in order of Y, M, C and K, it is preferable to increase the melting temperature of each ink 1*a* in the same order as shown by A in FIG. 15. In other words, it is preferable to consider the difference of their melting temperatures and transfer the inks in order of the lowness of melting temperature. By doing so, a newly transferred ink 1*a* (e.g. M) can melt the already transferred ink 1*a* (e.g. Y). Thus, as shown in FIG. 16A, both of different inks 1*a* can smoothly permeate into the thin groove 2*a*1 of the multi-grooved recording medium 2, thereby stabilizing the transfer condition of inks 1*a*. No ink will be peeled off the recording medium 2.

Figure 16B:
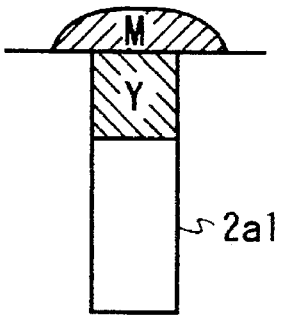

On the contrary, if the inks 1*a* are printed in order of the highness of melting temperature as shown by B in FIG. 15, there is a possibility that the following ink 1*a* (i.e. M) fails to sufficiently permeate into the recording medium 2 as shown in FIG. 16B.

The ink 1*a* is required to be in a solid state at room temperatures and to be in a liquid state when heated. Furthermore, it is necessary to suppress the thermal deformation as small as possible in both of the thin film 1*b* of the ink ribbon 1 and the multi-grooved recording medium 2. Hence, a preferable melting temperature of the ink 1*a* will be selected in the region of 60°–1100° C.

For the printing order of Y, M, C and K, it is preferable that the viscosity of each ink when melted increases in the same order. This is because the lower viscosity enables the ink to easily permeate into the thin groove 2*a*1 of the multi-grooved recording medium 2. Exemplary values of viscosity are as follows: 1.0 cp (centi-poise) for water, 50 cp for tung oil, and 100 cp for caster oil. A viscosity of melting-type ink varies depending on temperature, and will be selected in the range of 50–200 cp when the heating temperature is 90° C.

Next explained is another preferable embodiment of the multi-grooved recording medium 2 serving as the recording medium for use in thermal transfer printing operations of the present invention.

The inventor of the present invention has found the fact that the smoothness of the substrate 2*b* of the multi-grooved recording medium 2 has a significant effect on the quality of printed images. In the experiment conducted by the inventor, there are prepared various substrates 2*b* different from each other in their surface features, each of substrates 2*b* being formed with the same multi-grooved layer 2*a* (average groove width: 1–10 μm). Each of thus formed multi-grooved layer 2*a* is subjected to the thermal transfer printing operation based on the above-described permeable method. Table 1 shows an evaluation result of this experiment.

TABLE 1

| RECORDING MEDIUM NUMBER | SURFACE FEATURES BECKE'S SMOOTHNESS | SURFACE ROUGHNESS | EVALUATION RESULT | INK TRANSFER CONDITION |
|---|---|---|---|---|
| REC. MEDIUM #1 | 302 SEC | 4.9 μm | BAD | |
| REC. MEDIUM #2 | 500 SEC | 3.1 μm | NO GOOD | FIG. 17B |
| REC. MEDIUM #3 | 922 SEC | 2.2 μm | GOOD | |
| REC. MEDIUM #4 | 1400 SEC | 1.8 μm | GOOD | |
| REC. MEDIUM #5 | 2000 SEC | 0.9 μm | VERY GOOD | FIG. 17C |

In this experiment, the thermal head 3 has a line length of 259.6 mm, with 12 dots/mm. A pressing force of 14 kg is applied to the thermal head 3. The ink ribbon 1 comprises a thin film (i.e. a polyester film) of 3.5 μm thick and an ink 1*a* of a coating amount 2.0 g/m$^2$. The heating amount of the thermal head 3 was controlled to be constant always. The evaluation was provided based on a visual judgement on the uniformity of ink 1*a* in the permeated condition when the ink 1*a* is transferred to the multi-grooved recording medium 2.

Figure 17A:
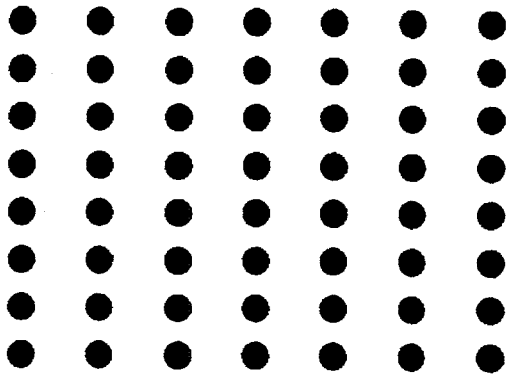
FIGS. 17A, 17B and 17C are views illustrating a thermal transfer recording medium in accordance with another preferable embodiment of the present invention.
Figure 17B:
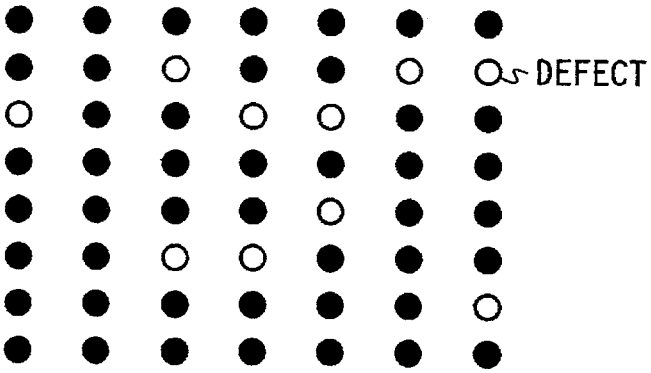
Figure 17C:
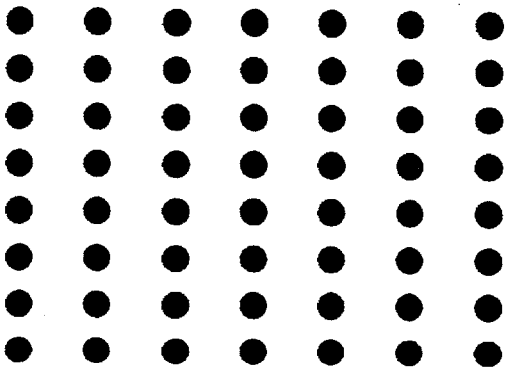

When the multi-grooved recording medium 2 is printed by the dot images shown in FIG. 17A, the resultant print image was bad in the recording medium #1 which has a Becke's smoothness of 302 seconds and a surface roughness of 4.9 μm. For the recording medium #2 having a Becke's smoothness of 500 seconds and a surface roughness of 3.1 μm, the resultant print image was not satisfactory since some of dots the are defective and not accurately printed as shown in FIG. 17B. On the other hand, the resultant print image was good in each of the remaining samples, i.e. the recording medium #3 having a Becke's smoothness of 922 seconds and a surface roughness of 2.2 μm, the recording medium #4 having a Becke's smoothness of 1400 seconds and a surface roughness of 1.8 μm, and the recording medium #5 having a Becke's smoothness of 2000 seconds and a surface roughness of 0.9 μm. Especially, the recording medium #5 provided an excellent print image as shown in FIG. 17C.

Although the table 1 specifies both values of Becke's smoothness and surface roughness, an acceptable result will be obtained when at least one of these two conditions is satisfied.

According to the above experimental result, it is considered that an excellent multi-gradational image with high resolution and high quality can be obtained when the substrate 2*b* of the multi-grooved recording medium 2 has a Becke's smoothness not smaller than 500 seconds or a surface roughness not larger than 3 μm. A preferable Becke's smoothness is more than 900 seconds, while a preferable surface roughness is less than 2 μm. An optimum result is obtained when the Becke's smoothness is more than 2000 seconds or the surface roughness is less than 1 μm. The smoother the substrate 2*b*, the better the result. Thus, there is no upper limit for the Becke's smoothness and no lower limit for the surface roughness.

Regarding the reason why the substrate 2*b* of the multi-grooved recording medium 2 has an effect on the resultant print image, it is believed that the surface of the substrate 2*b* causes a deformation when the multi-grooved recording medium 2 laid on the ink ribbon 1 is subjected to heat and a large pressure by the thermal head 3, and this deformation induces a deformation of the surface of the multi-grooved layer 2*a* because the multi-grooved layer 2*a* is integral with the substrate 2*b*. In other words, merely requiring smoothness of the surface of the multi-grooved layer 2*a* is not always effective, since the surface of the multi-grooved layer 2*a*, even if it is perfectly smoothed, is easily deformed when the smoothness of substrate 2*b* is not satisfactory.

As described in the foregoing description, the present invention provides a thermal transfer recording medium for use in a hot-melting-type thermal transfer print system using a hot-melting-type ink, the recording medium comprising: a substrate; a multi-grooved layer formed on the substrate; a plurality of thin grooves formed on a surface of the multi-grooved layer, each thin groove having a width of 1–10 μm and a length longer than a pixel at least in an auxiliary scanning direction. With this arrangement, each thin groove allows molten ink to permeate smoothly along the elongated recess thereof. Thus, it becomes possible to use the hot-melting-type ink for providing an excellent multi-gradational image with high resolution and quality.

Furthermore, the present invention provides a hot-melting-type thermal transfer print system comprising: an ink ribbon including a thin film on which a hot-melting-type ink is applied with a coating amount not larger than 2.5 g/m$^2$, the hot-melting-type ink being a mixture of paint material and hot-melting-type binder; a multi-grooved recording medium including a substrate and a multi-grooved surface layer formed on the substrate, the multi-grooved surface layer having a plurality of thin grooves, each thin groove having a width of 1–10 μm; a thermal head with a plurality of heat generators, arrayed in a line so as to provide a temperature gradient with highest temperatures in a central region thereof and lower temperatures in a peripheral region thereof; and a gradation control circuit controlling a power supply to the thermal head, so as to control a melting area of the ink when the ink is heated by the heat generators; wherein the ink of the ink ribbon is laid on the multi-grooved surface layer of the multi-grooved recording medium, a pressing force is applied to the thermal head from the same side as the thin film of the ink ribbon, the gradation control circuit controls the melting area of the ink, thereby obtaining a multi-gradational image on the multi-grooved recording medium.

Accordingly, the molten ink sufficiently permeates into the thin grooves formed on the multi-grooved surface layer. Thus, it becomes possible to provide a stable multi-gradational image with excellent resolution and quality.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A thermal transfer medium for use in a hot-melting-type thermal transfer print system using a hot-melting-type ink, the recording medium comprising:

a substrate;

a multi-grooved layer formed on said substrate;

a plurality of substantially parallel thin grooves formed on a surface of said multi-groove layer, each thin groove having a width of 1–10 μm and a length longer than a pixel.

2. The thermal transfer recording medium in accordance with claim 1, wherein said substrate satisfies at least one of first and second conditions, said first condition being that said substrate has a Becke's smoothness not smaller than 500 seconds while said second condition being that said substrate has a surface roughness not larger than 3 μm.

3. The thermal transfer recording medium in accordance with claim 1, wherein said thin grooves are arrayed in parallel with each other and extend in an auxiliary scanning direction.

4. The thermal transfer recording medium in accordance with claim 3, wherein said substrate satisfies at least one of first and second conditions, said first condition being that said substrate has a Becke's smoothness not smaller than 500 seconds while said second condition being that said substrate has a surface roughness not larger than 3 μm.

5. A hot-melting-type thermal transfer print system comprising:

an ink ribbon including a thin film on which a hot-melting-type ink is applied with a coating amount not larger than 2.5 g/m$^2$, said hot-melting-type ink being a mixture of paint material and hot-melting-type binder;

a multi-grooved recording medium including a substrate and a multi-grooved surface layer formed on said substrate, said multi-grooved surface layer having a plurality of thin substantially parallel grooves, etch thin groove having a width of 1–10 μm;

a thermal head with a plurality of heat generators, arrayed in a line so as to provide a temperature gradient with highest temperatures in a central region thereof and lower temperatures in a peripheral region thereof; and a gradation control circuit controlling a power supply to said thermal head, so as to control a melting area of said ink when said ink is heated by said heat generators;

wherein said ink of said ink ribbon is laid on said multi-grooved surface layer of said multi-grooved recording medium, a pressing force is applied to said thermal head from the same side as said thin film of said ink ribbon, said gradation control circuit controls the melting area of said ink, thereby obtaining a gradational image on said multi-grooved recording medium.

6. The hot-melting-type thermal transfer print system in accordance with claim 5, wherein the width of said thin groove of said multi-grooved surface layer satisfies the following equation:

$$\phi \leqq k \leqq 4T$$

where, k is the width of said thin groove of said multi-grooved surface layer, $\phi$ is a paint particle size of said ink and, T is a thickness of said ink applied on said thin film of said ink ribbon.

7. The hot-melting-type transfer print system in accordance with claim 6, wherein said thin grooves of said multi-grooved surface layer in said multi-grooved recording medium are arrayed in parallel with each other and extend in an auxiliary scanning direction of said thermal head.

8. The hot-melting-type transfer print system in accordance with claim 7, wherein the pressing force per unit length of a printing length of said thermal head is not less than 0.35 kg/cm.

9. The hot-melting-type transfer print system in accordance with claim 6, wherein the pressing force per unit length of a printing length of said thermal head is not less than 0.35 kg/cm.

10. The hot-melting-type transfer print system in accordance with claim 5, wherein said thin grooves of said multi-grooved surface layer in said multi-grooved recording medium are arrayed in parallel with each other and extend in an auxiliary scanning direction of said thermal head.

11. The hot-melting-type transfer print system in accordance with claim 10, wherein the pressing force per unit length of a printing length of said thermal head is not less than 0.35 kg/cm.

12. The hot-melting-type transfer print system in accordance with claim 5, wherein the pressing force per unit length of a printing length of said thermal head is not less than 0.35 kg/cm.

* * * * *